United States Patent [19]

Di Rosa

[11] 4,062,428

[45] Dec. 13, 1977

[54] STOP DEVICES FOR OVERHEAD CONVEYORS

[75] Inventor: Gaetano Di Rosa, Pino Torinese (Turin), Italy

[73] Assignee: FATA S.p.A., Turin, Italy

[21] Appl. No.: 744,554

[22] Filed: Nov. 24, 1976

[30] Foreign Application Priority Data

Dec. 23, 1975 Italy ..... 70174/75

[51] Int. Cl.[2] ..... F16F 9/18

[52] U.S. Cl. ..... 188/275; 193/35 A

[58] Field of Search ..... 188/1 B, 85, 266, 271, 188/275, 284, 286; 74/821–823; 193/35 A

[56] References Cited

U.S. PATENT DOCUMENTS 2,140,357 12/1938 Hanna ..... 188/275

*Primary Examiner*—Duane A. Reger

*Attorney, Agent, or Firm*—Sughrue, Rothwell, Mion, Zinn and Macpeak

[57] ABSTRACT

A blocking device for an overhead conveyor having a combined limit stop and shock absorber which acts to define the end positions of a drive device which moves the blocking device between an operative and an inoperative position. The combined shock absorber and limit stop device comprises a body having two parallel plungers sliding in parallel bores of the body, the bores being linked at their closed ends by a passage having a restrictor throttle therein, the interior passage and the chambers are filled with oil which, upon its passage through the restrictor throttle, when one of the plungers is depressed, dissipates energy causing the depression and also serves to push out the other plunger ready for a subsequent depression when the device moves from one position to the other.

1 Claim, 8 Drawing Figures

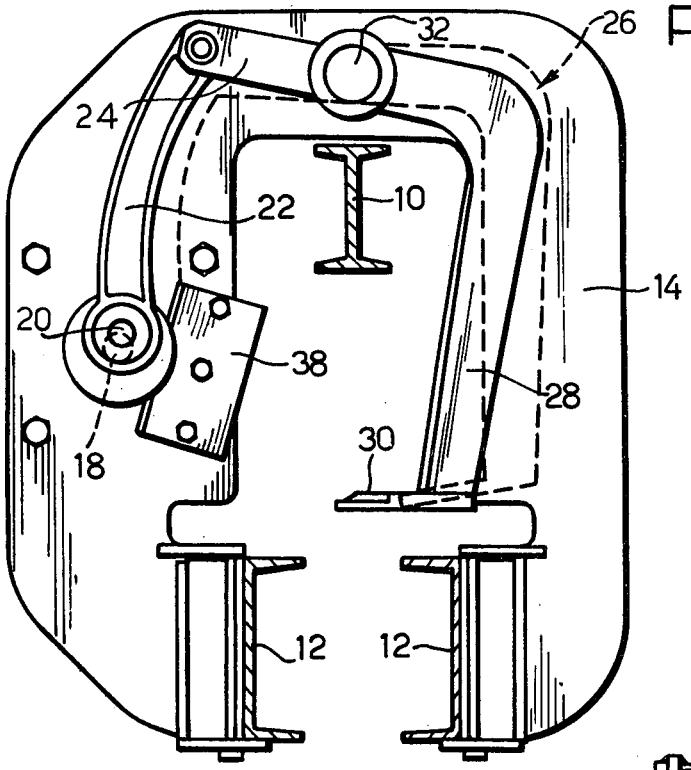
FIG. 1
FIG. 2
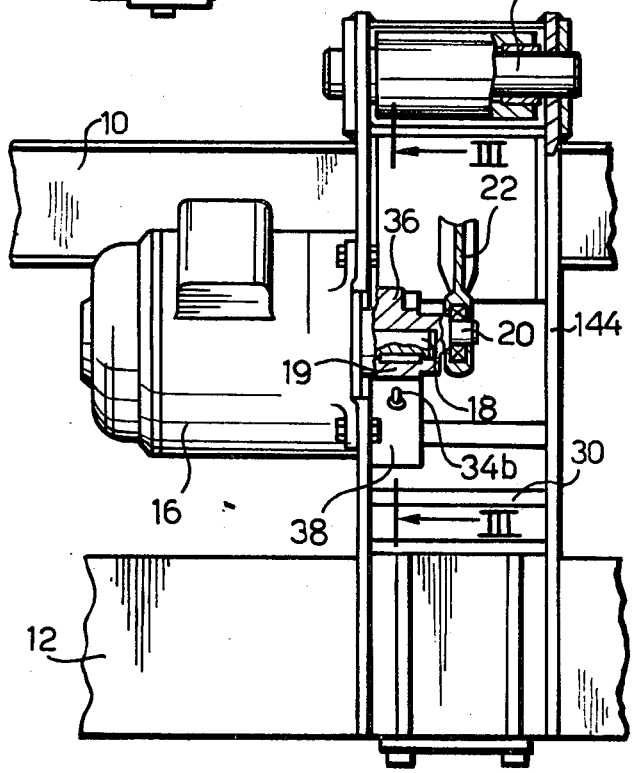

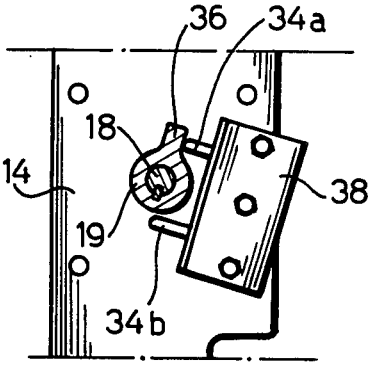
FIG. 3
FIG. 4
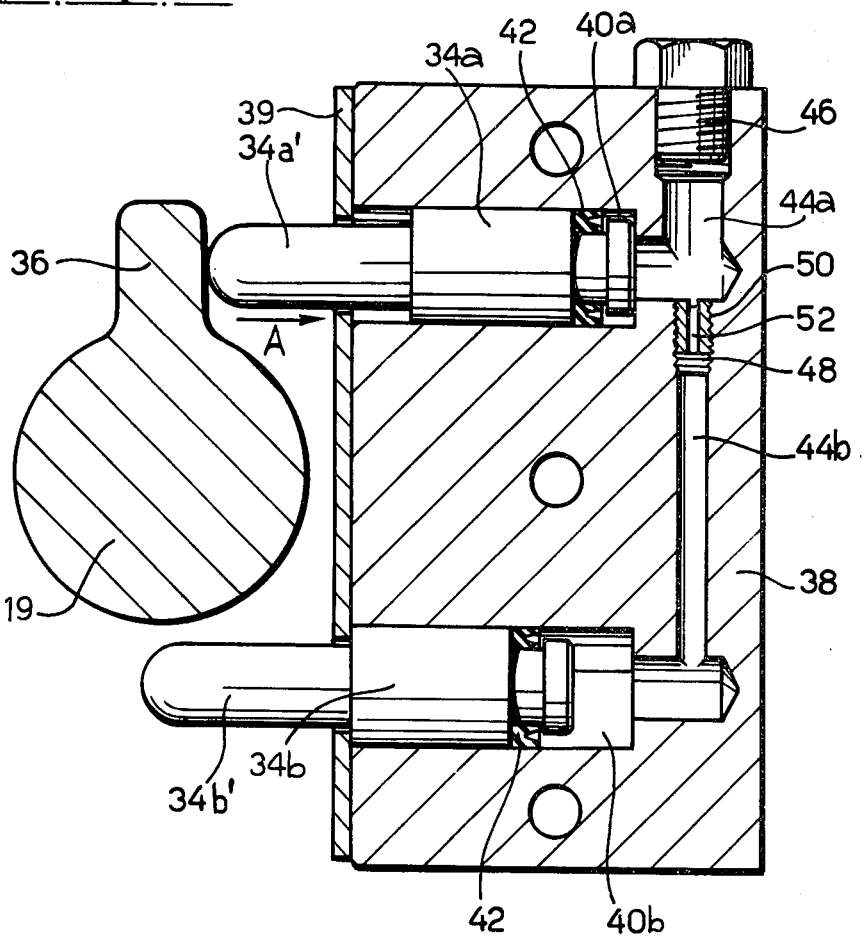

STOP DEVICES FOR OVERHEAD CONVEYORS

This invention relates to a stopping device of a type used in overhead conveyors, which is particularly suitable for use in conveyors of the type having two rails, to stop trucks or other carriages travelling along the rail or rails of the conveyor at a particular point along the conveyor.

Stopping devices for this purpose (also known as blocking devices) usually comprise a blocking element which is movable between two positions, that is a rest position in which it allows the passage of the trucks or carriages which travel along the conveyor, and an operative position, in which it stops the trucks or carriages and disengages the conveyor hopper carried upon the first of the trucks or carriages by the thrusting finger borne by the conveyor chain. In known stopping devices of this type the limit positions of the stopping or blocking member are determined by means of abutments which limit the movement of the driving device which causes the movement of the movable blocking member. This is usually achieved by means of two abutment stops against which this driving device abuts at each of its two end positions.

In one known such stopping device the driving device is an electric motor of the type known as a "torque motor", that is a motor the field windings of which can be energised when the rotor is held stationary so that maximum torque is applied to the motor while it is stationary. The motor can be operated to turn in either direction of rotation and is usually controlled by a timer or other control device which periodically reverses the direction of the current to the motor so that it turns first in one direction and then in the other.

Attached to the motor spindle is an element having a radial projection which, in the two angular end positions of the motor abuts against two adjustable abutment stops which are usually positioned so that the motor turns through about 180° between the two angular end positions.

Because the field windings of the motor remain energised when the motor is in its end positions the radial projection of the element on the motor spindle is driven hard against the abutment stops each time it changes position. This means that the component parts of the device are continually being subjected to dynamic stresses arising from the impact of the indexing projection against the abutment stops, as well as the impact of the carriage against the blocking element when it is moved into the blocking position. These impacts, apart from the stresses they impose on the parts of the conveyor, also constitute an undesirable source of noise.

In an attempt to reduce the stresses and noise arising from the impact of the indexing projection against the abutment stops these latter have sometimes been provided with resilient abutment elements which serve to absorb the kinetic energy of the moving parts as the projection strikes against the abutment stops. It has also been proposed to make the abutment stops and/or the projection of a resilient material which can absorb the kinetic energy by deformation upon impact. However, in such arrangements the kinetic energy is not really dissipated, but rather is stored as potential energy in the deformed resilient elements which subsequently return to their original shape giving rise to rebound phenomena which can effect the performance of the stopping device, either by not being properly positioned for stopping the strucks or in not opening fully to permit trucks or carriages to pass when required so that some of the trucks or carriages foul against the stopping device as they pass, perhaps even being stopped by the device, supposedly in its open position, and certainly giving rise to further undesirable noise.

Another disadvantage of systems using resilient elements is the limited life of the resilient elements due to the high specific pressures and forces involved.

The present invention seeks therefore to provide a stopping device of the type suitable for use in a conveyor, which does not have the disadvantages mentioned above.

According to the present invention a combined shock absorber and limit stop device suitable for use with a blocking device of an overhead conveyor of the type having a movable element driven between two end positions by a drive device, the end positions being defined by abutment stops of the limit stop device, is characterised in that each of the abutment stops of the device comprise a plunger slidable in a body of the device, the plungers being associated with means for dissipating kinetic energy upon displacement of one of the plungers, from a first position to a second position thereof, and for returning the other plunger from its second to its first position.

The advantage gained from the construction of the invention is that the kinetic energy of the moving parts of the device is dissipated, when the plungers are displaced, over the distance by which the plungers move, thus reducing quite substantially the noise resulting from the impact of the projection against the abutment stops. If the shock absorber is of the hydraulic, or pneumatic, type, then preferably each plunger is slidable within a respective chamber, the two chambers being connected together by a conduit, the said conduit having a restrictor throttle between the two chambers within which slide the plungers. The advantage of this construction is that the hydraulic fluid which flows through the throttle serves not only as the means of energy dissipation but also to return at each impact, the previously displaced plunger back into its original position.

In the preferred embodiment of the invention the two chambers are formed in a single body of the device, and the said conduit linking the two chambers is formed as a passage within the body. This allows economical manufacture and simple and speedy assembly of the component parts.

One embodiment of the invention will now be more particularly described, by way of example, with reference to the accompanying drawings, in which:

FIG. 1 is a cross sectional view of a conveyor, at the position of the stopping device;

FIG. 2 is a side view of the stopping device shown in FIG. 1, partially in section;

FIG. 3 is a section taken on the line III-III of FIG. 2;

FIG. 4 is a sectional view, on a larger scale, of the shock absorber shown in FIG. 3.

Figure 5:
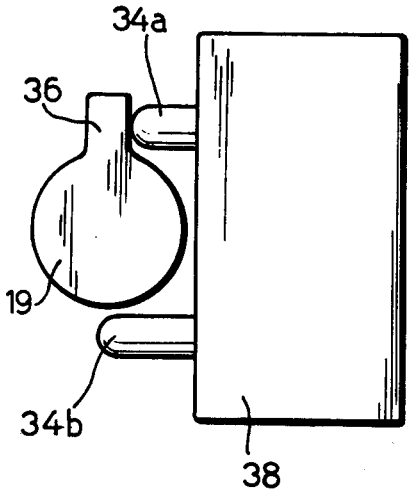
FIGS. 5 to 8 illustrate the operation of the shock absorber shown in FIGS. 3 and 4 in various different working positions.
Figure 6:
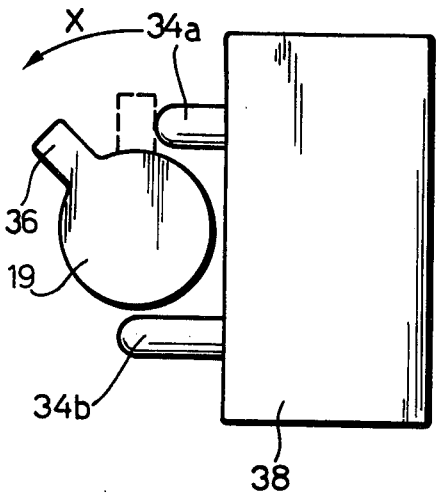

Referring now to the drawings, and particularly to FIGS. 1 and 2, there is shown a blocking device for an overhead conveyor of the type having an upper rail 10 and a pair of lower rails 12. The upper rail 10 carries support elements of a conveyor chain, while the two rails 12 carry load-bearing trucks which have conveyor hoppers upon which act pusher elements carried by the chain. The blocking device illustrated in the drawing is of the type described and illustrated in Italian Pat. No. 794,498 by the same Applicant.

The rails 10, 12 of the conveyor are supported on a support frame 14 which also carries a torque motor 16 having an output shaft 18 onto which there is keyed a sleeve 19 bearing an eccentric pin 20. On to the pin 20 there is pivoted one end of a connecting rod 22 the other end of which is pivotally connected to an arm 24 of a crank lever 26, the other arm 28 of the crank lever 26 being L-shaped. The free end of the said other arm 28 of the lever 26 bears at its free end a blocking element 30.

Upon rotation of the motor shaft 18 the lever 26 is driven between two positions in relation to the rails of the conveyor. In the first or "open" position (shown by a broken line in FIG. 1) the blocking element 30 is withdrawn so that any load-bearing trucks or carriages (not illustrated) travelling past the stopping device on the rails 12 can pass freely without obstruction. In the other, or "closed", position of the lever 26 (i.e. in the blocked position drawn as a continuous line in FIG. 1) the blocking element 30 impedes the passage of any load-bearing trucks which arrive along the rails 12, releasing the conveyor hopper of the first load-bearing struck from the pusher borne by the chain.

The movement of the lever 26 from the "open" to the "closed" position or vice-versa only requires the torque motor 16 to turn through 180° from one angular end position to another, and this is achieved by a control device (not shown) of a known type which will not be described in detail herein. When the shaft 18 turns this causes the eccentric pin 20 to move around the axis of the output shaft thereby displacing the connecting rod 22 and causing the lever 26 to rock between the two end positions described above, moving the blocking element into one or other of its end positions.

The sleeve 19 has a radial projection 36 which abuts against one or other of two abutment stops 34*a*', 34*b*' to positions which the shaft 18 can assume in its rotating movement thus determining the two end positions of the blocking member 30. The two abutment stops 34*a*', 34*b*' are in fact the projecting stems of two small sliding plungers which are part of a shock absorber which absorbs the kinetic energy of the moving parts of the device as it reaches one or other of its end positions. The shock absorber is shown in greater detail in FIG. 4, and comprises a body 38 in which are formed two parallel cylindrical chambers 40*a*, 40*b*. Within the two chambers 40*a*, 40*b* slide two small plungers 34*a*, 34*b* which are fitted with sealing rings 42 around a body part from which project respective plunger stems 34*a*', 34*b*'. The two cylindrical chambers 40*a*, 40*b* are closed by a cover plate 39 having two holes in register with the bores forming the chambers 40*a*, 40*b*; these holes are large enough to allow the plunger stems 34*a*', 34*b*' to project therethrough but small enough to provide an abutment for the radial shoulder between the plunger stem 34*a*', 34*b*', and the body of the respective plunger 34*a*, 34*b*, to prevent it from leaving the chamber 40*a*, 40*b*.

The two cylindrical chambers 40 are connected together by a passage 44 which opens into one wall of the body 38 through an aperture which is closed by a screwed blanking-off plug 46. The passage 44 has a wider part 44*a* and a narrower part 44*b*, which latter is threaded over a section 48 adjacent the wider part 44*a*. Screwed into this threaded section is a jet 50 having a calibrated orifice 52 serving as a restrictor throttle for fluid flowing from the passage 44*a* to the passage 44*b* or vice-versa. The chambers 40 and the passages 44*a* and 44*b* are completely filled with oil so that if the plunger 34*a* moves in the direction shown by the arrow A of FIG. 4 the oil contained in the corresponding chamber 40*a* will be forced through the throttle orifice 52 along the passage 44*b* and into the chamber 40*b*, thus displacing the plunger 34*b* by an amount equal to that by which the plunger 34*a* is displaced. Likewise, on subsequent depression of the plunger 34*b*, the oil passes back through the throttle orifice 52 into the chamber 40*a* of the plunger 34*a* displacing this latter outwardly. The device thus acts to absorb kinetic energy when one of the plungers is depressed.

Figure 7:
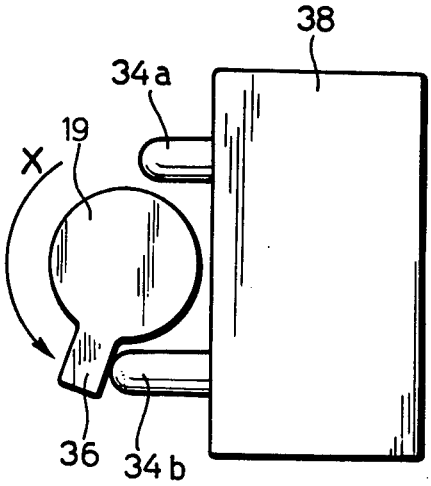
Figure 8:
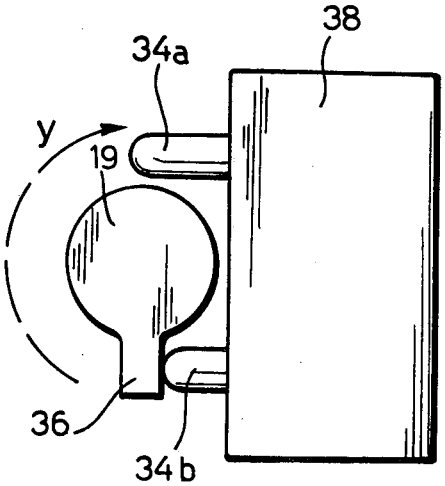

FIGS. 5 to 8 illustrate the sequence of operation of the shock absorber device: in the position illustrated in FIG. 5 the motor shaft 18 is in one angular end position. The radial projection 36 on the sleeve 19 fixed to the shaft 18 of the motor 16, is pressed against the abutment stop formed by the plunger stem 34*a* and the plunger 34*a* is fully depressed. Subsequently the motor shaft 18 starts turning in the direction of the arrow X in order, for example, to move the blocking device into its "open" position. The plunger 34*a* remains in its depressed position. As it reaches the end of the angular movement the radial projection 36 of the sleeve 19 comes into contact with the stem 34*b*' of the plunger 34*b* which is in the forward position. This is shown in FIG. 7. The projection 36, when it strikes the plunger 34*b*, is decelerated thereby and presses the plunger 34*b* into its depressed position. The deceleration of the projection 36, and thus of the motor shaft 18 and the motor 16 takes place over the length of the stroke of the plunger 34*b* and thus this deceleration is far less severe than if the abutment stops were fixed rigid, or even resilient, elements.

The plunger 34*a* is, of course, pushed back to its forward position by the oil transferred from the chamber 40*b* of the plunger 34*b* to the chamber 40*a* of the plunger 34*a*, the energy of the moving parts being absorbed by the throttle 52. The shock absorber is thus ready to absorb the impact of the projection 36 when the shaft 18 of the motor 16 again turns to bring it into contact with the plunger stem 34*a*'.

Although the preceding description relates to an embodiment of the invention in which the stop device is driven by a torque motor, it will be clear to those skilled in this art that many other known types of drive device could be used instead, for example, the drive device may be an electromagnetic drive.

What is claimed is:

1. A combined shock absorber and limit stop device for a driven shaft which is adapted to be rotated about 180° in opposite directions comprising a driven shaft having a radially extending projection secured thereto for engagement with said combined shock absorber and limit stop device and means for driving said shaft in opposite directions, said combined shock absorber and limit stop device being disposed adjacent said shaft and comprising first and second parallel plungers disposed orthogonally to said shaft with each plunger having an end disposed substantially diametrically opposite the end of the other plunger for engagement by said projection, housing means defining first and second plunger chambers within which said first and second plungers are slidable respectively between first and second end positions, a conduit interconnecting said first and second chambers, a restrictor throttle in said conduit to restrict the flow of a fluid between said chambers and means for limiting the movement of said plungers in opposite directions between said first and second end positions.

* * * * *